US007235039B2

(12) United States Patent
Anders

(10) Patent No.: US 7,235,039 B2
(45) Date of Patent: Jun. 26, 2007

(54) FULL BODY STRETCHING ASSIST DEVICE

(76) Inventor: Douglas H. Anders, 520 Lakehurst, Waterloo, NE (US) 68069

( * ) Notice: Subject to any disclaimer, the term of this patent is extended or adjusted under 35 U.S.C. 154(b) by 0 days.

(21) Appl. No.: 11/581,186

(22) Filed: Oct. 13, 2006

(65) Prior Publication Data

US 2007/0032347 A1 Feb. 8, 2007

Related U.S. Application Data

(63) Continuation-in-part of application No. 11/066,983, filed on Feb. 25, 2005, now abandoned.

(60) Provisional application No. 60/548,748, filed on Feb. 27, 2004.

(51) Int. Cl.
*A63B 71/00* (2006.01)
*A61H 5/00* (2006.01)

(52) U.S. Cl. ..... 482/51; 482/907; 601/35

(58) Field of Classification Search ..... 482/51, 482/57, 148, 907, 133–135, 138; 601/35
See application file for complete search history.

(56) References Cited

U.S. PATENT DOCUMENTS 4,702,168 A * 10/1987 Colle et al. ..... 102/313
4,768,779 A * 9/1988 Oehman et al. ..... 482/10
4,802,462 A * 2/1989 Reiss et al. ..... 601/35
4,893,808 A * 1/1990 McIntyre et al. ..... 482/5
4,895,543 A * 1/1990 Vermette ..... 446/105
5,252,076 A * 10/1993 Kelleher ..... 473/438
5,277,681 A * 1/1994 Holt ..... 482/112
5,324,247 A * 6/1994 Lepley ..... 482/134
5,474,086 A * 12/1995 McCormick et al. ..... 600/595
5,688,212 A * 11/1997 Walker ..... 482/83
6,672,998 B2 * 1/2004 Cook ..... 482/142
6,733,426 B2 * 5/2004 Bussell ..... 482/112

* cited by examiner

*Primary Examiner*—Stephen R. Crow
(74) *Attorney, Agent, or Firm*—Adam H. Jacobs

(57) ABSTRACT

A full body stretching assist device includes a base, a central support shaft mounted on the base, left and right arm support stretching sections extending outwards therefrom, and left and right leg support stretching sections. The left and right arm support stretching sections each include a shoulder multi-axis joint and an elbow hinge joint, while the left and right leg support stretching sections each include a hip multi-axis joint and a knee hinge. Powered movement devices such as pneumatic, hydraulic, mechanical or other such actuating devices are operatively connected to the left and right arm support stretching sections and the left and right leg support stretching sections for alternatively extending, retracting and pivoting them in response to computer commands from a computing device, thus causing controlled movement to stretch and move arm and leg limbs being supported therein.

15 Claims, 8 Drawing Sheets

FULL BODY STRETCHING ASSIST DEVICE

CROSS-REFERENCE TO RELATED PATENTS

This continuation-in-part patent application claims priority based on a provisional patent, specifically on the Provisional Patent Application Ser. No. 60/548,748 filed Feb. 27, 2004 and Non-Provisional patent application Ser. No. 11/066,983 filed Feb. 25, 2005 now abandoned.

BACKGROUND OF THE INVENTION

1. Technical Field

The present invention is directed to body stretching assist devices and, more particularly, to a full body, full range of motion stretching assist device which includes an upright center support shaft, left and right arm engagement sections for stretching the arms of the individual, left and right leg engagement sections for stretching the legs of the individual using the invention, and a programable computing device operatively connected to the stretching assist device to control extension, retraction and rotation of the various sections of the stretching device of the present invention thereby assisting the individual in his or her stretching exercises.

2. Description of the Prior Art

There has been an enormous increase in the interest of Americans in working out to maintain or improve their health, to tone their bodies, and to lose weight and stay in shape. The different types of activities in which persons engage in exercise is virtually unlimited, but whether it is primarily cardiovascular in nature or is intended to build strength or flexibility in the individual, almost all of these exercises have one thing in common, and that is that persons engaging in those exercises generally do not stretch sufficiently to warm up their muscles, tendons, and ligaments to prevent injury from occurring during the exercise. There are many different reasons why persons do not stretch sufficiently prior to exercise, among them that individuals may not be aware of the proper stretches to engage in prior to exercise, or may not take the necessary time to complete a proper stretching regime prior to beginning exercise. In either event, the possibility of injury is greatly increased during the exercise due to the lack of stretching of the appropriate muscles. There is therefore a need for a stretching device which will properly stretch and warm up an individual's muscles, joints, tendons, and ligaments, and will do so in an efficient and safe manner.

Numerous examples of stretching devices have been proposed in the prior art, including such devices as Chung, U.S. Pat. No. 5,913,755, Hsu, U.S. Pat. No. 6,352,495, and Carlstrom, U.S. Pat. No. 5,634,873. These devices and many others found in the prior art all have one thing in common, and that is specifically that they are designed for the stretching of a specific body part, be it the back, arm, leg, or torso. However, Applicant is unaware of any single invention found in the prior art which is designed for the stretching of the entire body of the individual preparing for exercise, and such a device would certainly be superior to those found in the prior art as it is designed to complement a full body workout as opposed to the working out of only certain body parts. There is therefore a need for a full body stretching device which will provide for assisted stretching of various body parts in a controlled and safe atmosphere.

Therefore, an object of the present invention is to provide an improved full body stretching assist device.

Another object of the present invention is to provide an improved full body stretching assist device which includes leg and arm support stretching sections which receive the arms and legs therein and assist in the stretching of the arms and legs through powered joints fitted on the arm and leg sections.

Another object of the present invention is to provide an improved full body stretching assist device which includes a computing device operatively connected to the stretching assist device and programmed to control and drive the stretching process on an individual-by-individual basis by flexing the various elements of the invention.

Another object of the present invention is to provide an improved full body stretching assist device which may be used by persons both short and tall and large and small, due to the many adjustable elements of the present invention.

Another object of the present invention is to provide an improved full body stretching assist device which can be used for the stretching of individual body parts, as well as being programmed for the stretching of the full body of the individual using the device.

Finally, an object of the present invention is to provide an improved full body stretching assist device which is relatively simple and durable in design and is safe and efficient in use.

SUMMARY OF THE INVENTION

A full body stretching assist device includes a base and an upwardly extending central support shaft mounted on and extending upwards from the base. Left and right arm support stretching sections are mounted on the central support shaft and extend outwards therefrom, each of the left and right arm support stretching sections including an upper arm engagement portion, a lower arm engagement portion, and a hand grip mounted at the outer end of the lower arm engagement portion. Left and right leg support stretching sections are mounted on one of the base and the central support shaft, each of the left and right leg support stretching sections including a thigh engagement portion, a calf engagement portion and a foot engagement portion mounted at the lower end of the calf engagement portion. The left and right arm support stretching sections each include a shoulder multi-axis joint connecting the center support shaft and the upper arm engagement portion, an elbow hinge joint connecting the upper arm engagement portion and the lower arm engagement portion and a wrist multi-axis joint connecting the lower arm engagement portion and the hand grip portion, while the left and right leg support stretching sections each include a hip multi-axis joint connecting one of the central support shaft and the base and the thigh engagement portion, a knee hinge connecting the thigh engagement portion and the calf engagement portion and an ankle hinge/multi-axis joint connecting the calf engagement portion and the foot engagement portion. Powered movement devices such as pneumatic, hydraulic, or other such actuating devices are operatively connected to the left and right arm support stretching sections and the left and right leg support stretching sections for alternatively extending, retracting and pivoting the left and right arm support stretching sections and the left and right leg support stretching sections at the shoulder multi-axis joint, the elbow hinge joint, the wrist multi-axis joint, the hip multi-axis joint, the knee hinge and the ankle hinge/multi-axis joint such that the left and right arm support stretching sections and the left and right leg support stretching sections are movable in various directions to stretch and move arm and leg limbs being supported therein. Finally, a computing device is operative to engage and control the powered movement devices to alternatively extend, retract and pivot the left and right arm support stretching sections and the left and right leg support stretching sections at the shoulder multi-axis joint, the elbow hinge joint, the wrist multi-axis joint, the hip multi-axis joint, the knee hinge and the ankle hinge/multi-axis joint, thus causing controlled movement of the left and right arm support stretching sections and the left and right leg support stretching sections in various directions to stretch and move arm and leg limbs being supported therein.

The full body stretching assist device as thus described provides a substantial improvement over the various stretching methods and devices currently available. For example, the stretching program which may be used with the present invention is highly individualized and, thus, the vast majority of persons working out at gyms and the like may use the present invention prior to exercising to decrease the chance for injury and increase their strength and flexibility. Also, the multiple adjustable features of the present invention may be quickly and easily adjusted to accommodate many different body sizes and types, thus permitting a large number of users of the present invention to benefit from use of the full body stretching assist device. Furthermore, the positioning of the joints of the present invention is designed to correspond to the location of the joints of the individual using the present invention, and thus the possibility for injury from use of the present invention is greatly reduced as the motions of the device replicate the motions of the individual using the present invention. Finally, the concentrated and efficient manner by which the present invention stretches the individual using the present invention makes it much more likely that the individual will probably stretch before exercising, which will likely result in a great reduction in the number of injuries incurred by persons working out at gymnasiums and the like. The present invention thus provides a substantial improvement over those devices and methods found in the prior art.

DESCRIPTION OF THE PREFERRED EMBODIMENT

Figure 1:
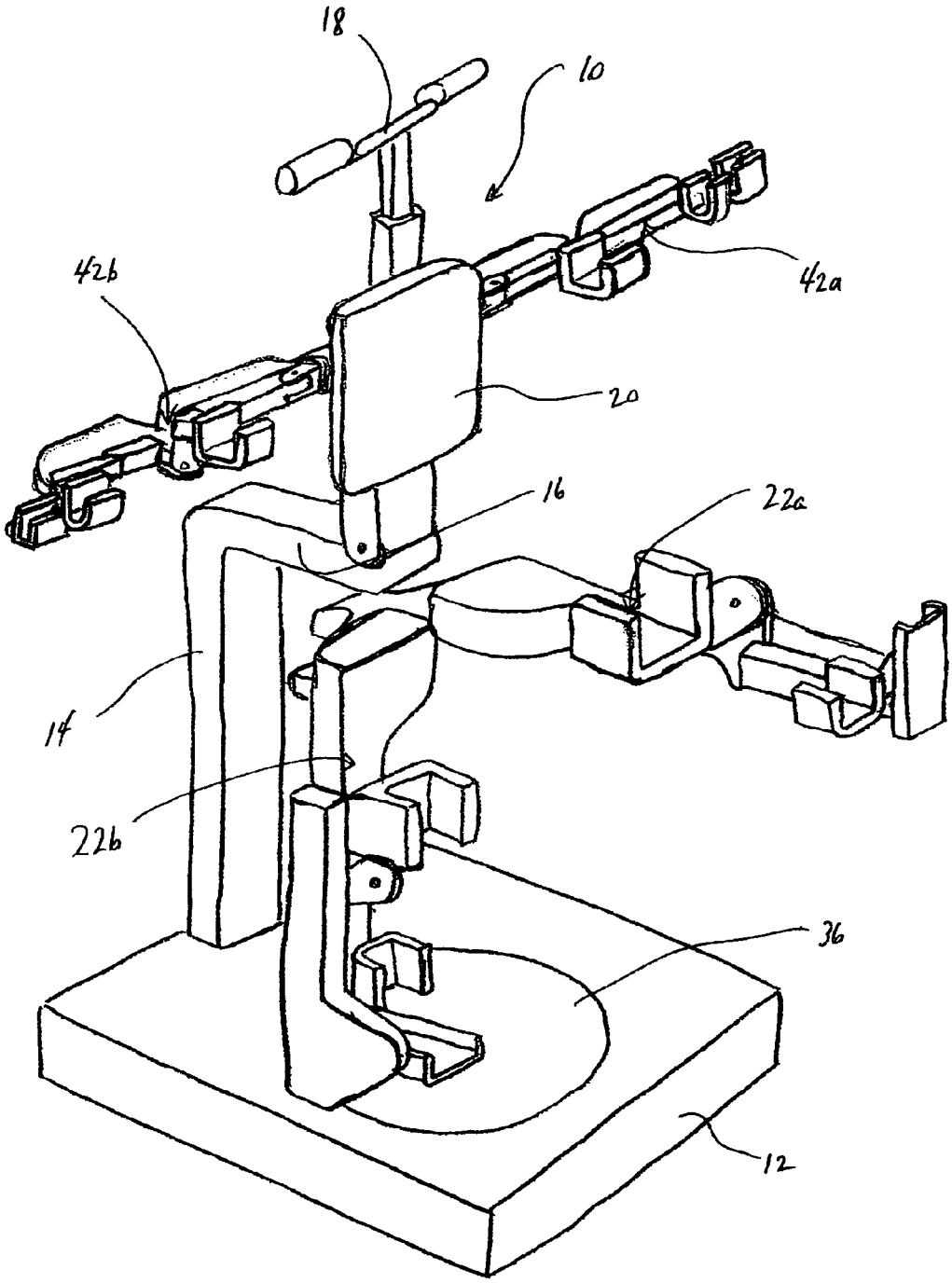
FIG. 1 is a perspective view of the full body stretching device of the present invention.
Figure 2:
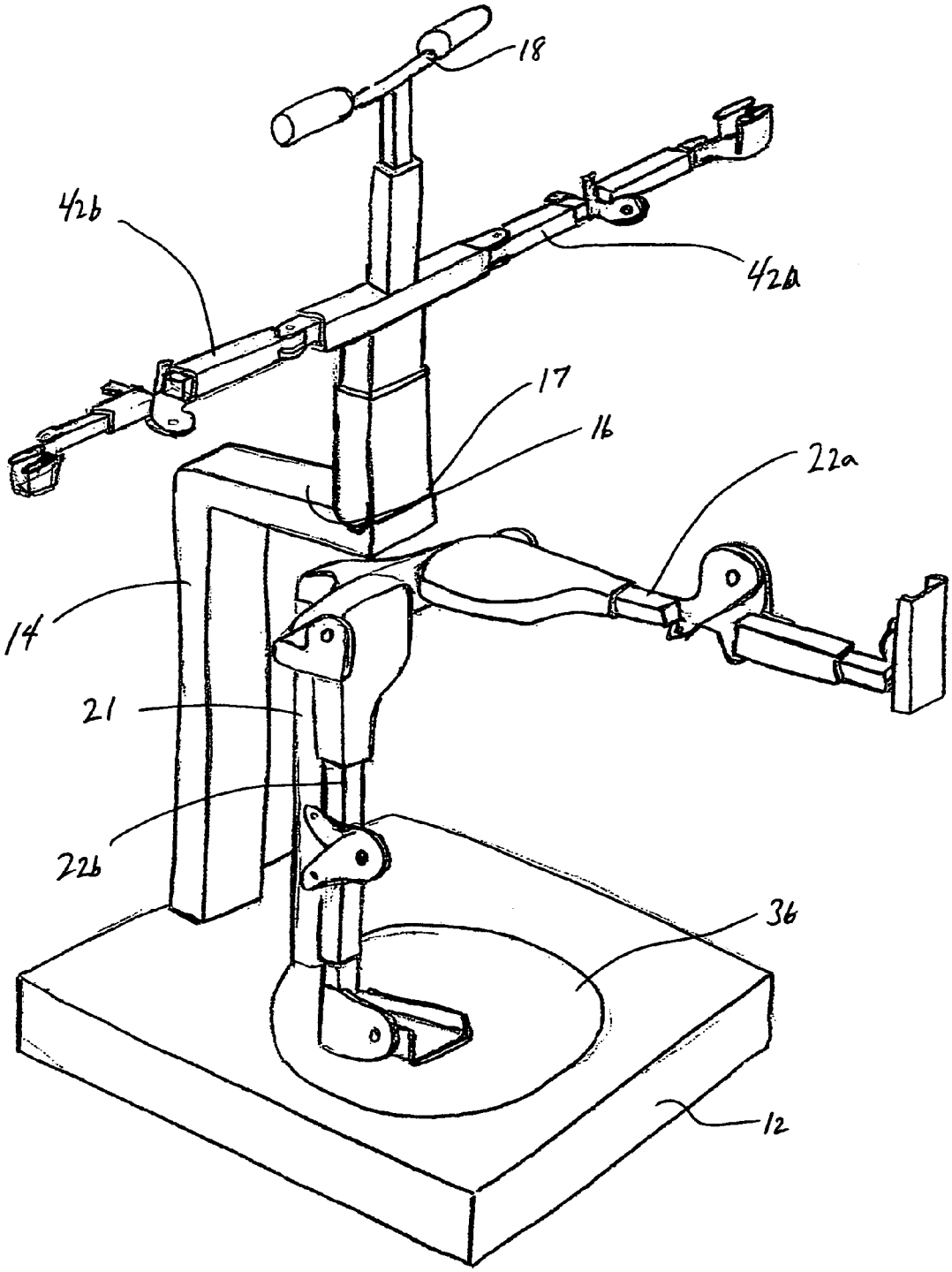
FIG. 2 is a detailed perspective view of the full body stretching device of the present invention with pads and padding removed.
Figure 3A:
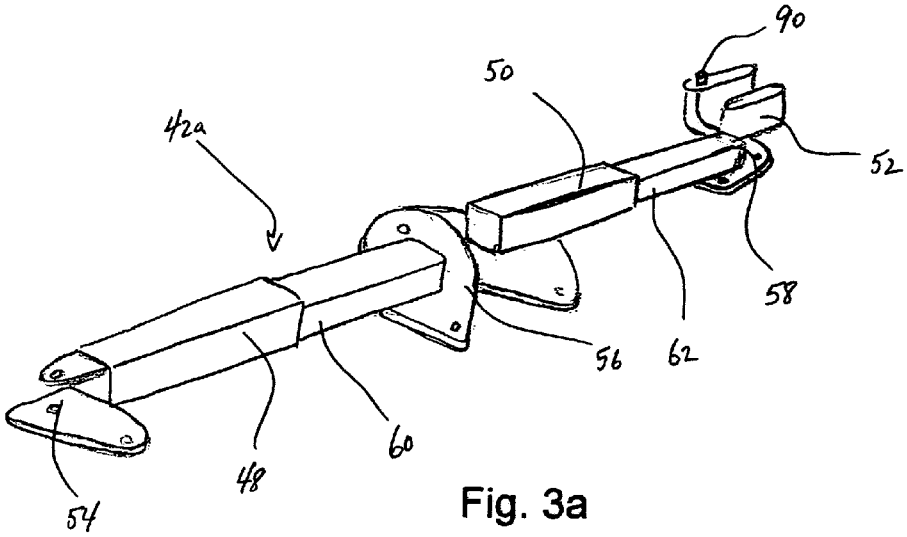
FIGS. 3*a* and 3*b* are detailed perspective views of the arm section of the present invention in different orientations.
Figure 3B:
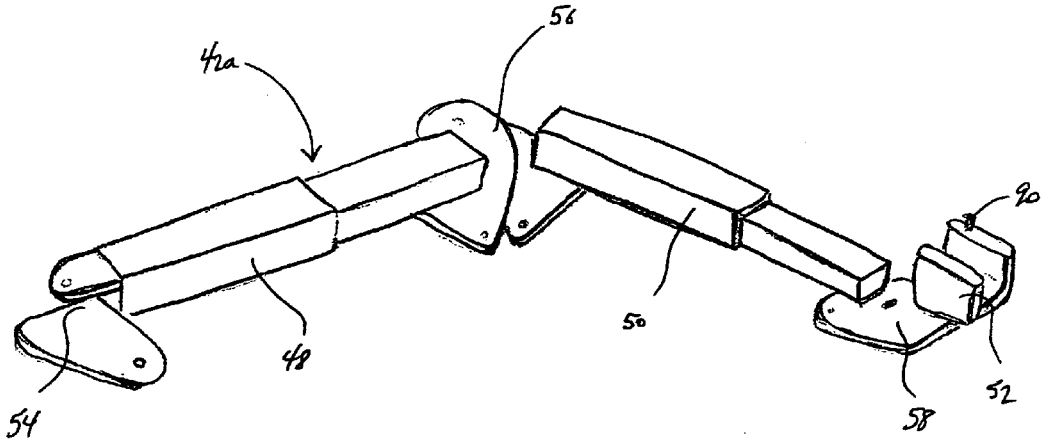
Figure 4A:
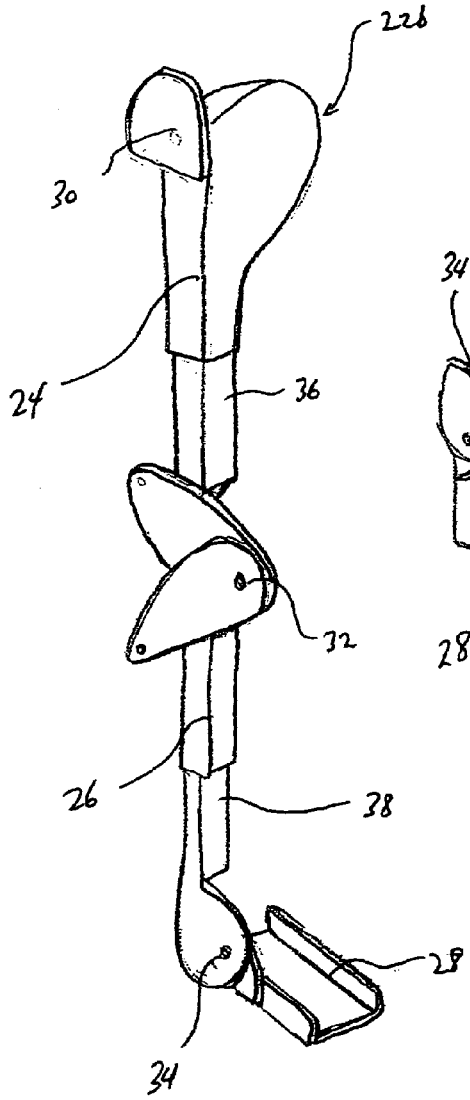
FIGS. 4*a* and 4*b* are detailed perspective views of the leg section of the present invention in different orientations.
Figure 4B:
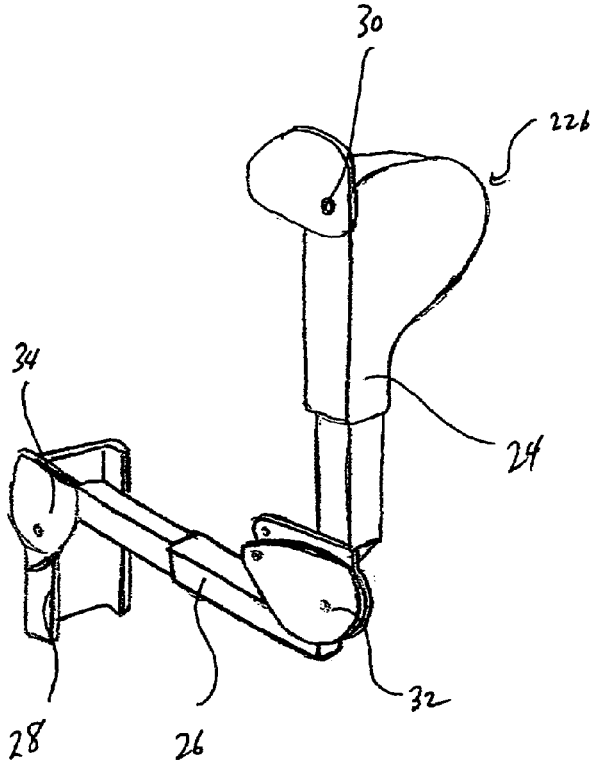

The full body stretching device 10 of the present invention is shown best in FIGS. 1–4 as including a base platform 12 on which is mounted an upright central support shaft 14 which is vertically movable to raise and lower the elements of the full body stretching device 10 of the present invention as desired for the user of the invention, as shown best in FIG. 1. Mounted on and extending upwards from the central support shaft 14 is an upper handle 18 and mounted on the forward portion of central support shaft 14 is a back and shoulder support pad 20 to provide additional support and comfort for the individual using the full body stretching device 10 of the present invention. The central support shaft 14 as shown preferably includes a horizontal offset section 16 which allows the central support shaft 14 to not interfere with the operation of the lower body portion of the present invention, specifically rotation of the lower body portion to enable torso stretching, the specifics of which will be described later in this disclosure.

Figure 5:
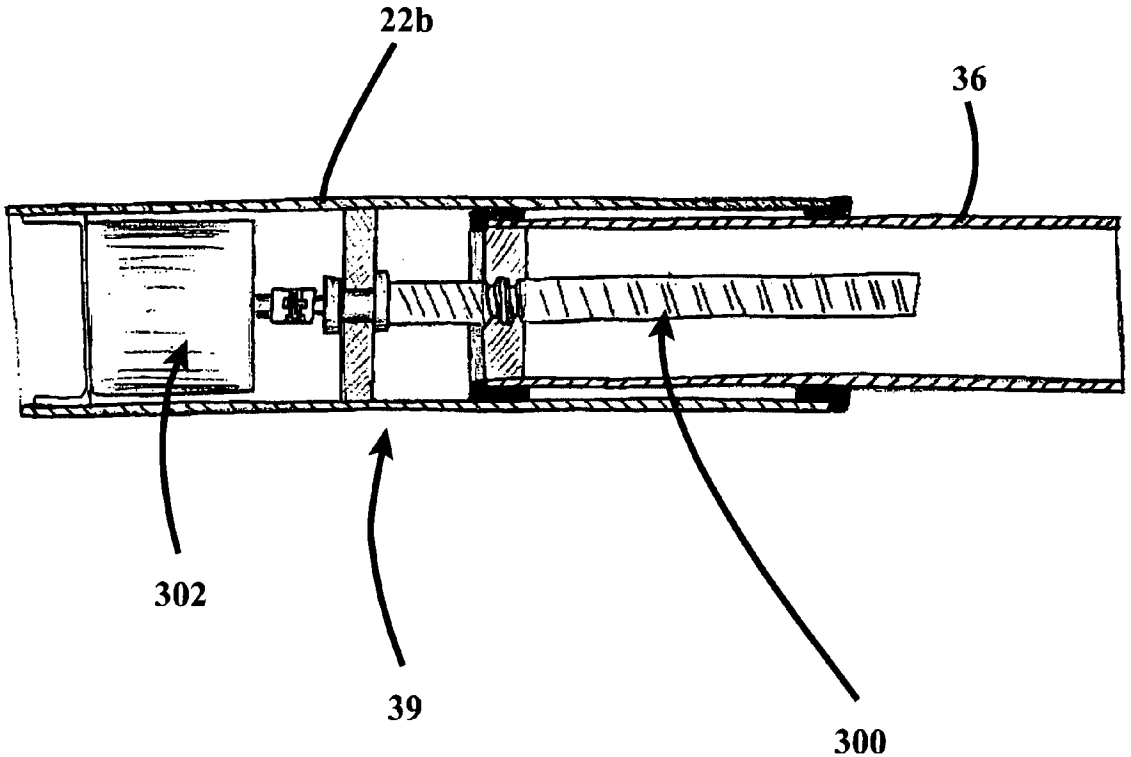
FIG. 5 is a detailed side elevational view of a powered extension device.

Mounted on an upwardly extending leg support mounting shaft 21 and extending downwards from the top portion of leg support mounting shaft 21 are left and right leg support stretching sections 22*a* and 22*b*, which, in the preferred embodiment, would be generally identical to one another, except being reversed to accommodate the left and/or right leg of the individual using the present invention. Therefore, the following description of right leg support stretching section 22*b* should be understood to apply equally to left leg support stretching section 22*a*. The right leg support stretching section 22*b* would include a thigh engagement portion 24, calf engagement portion 26, and foot engagement portion 28, with the connection between the central support shaft 14 and thigh engagement portion 24 being a multi-axis joint 30, the connection between thigh engagement portion 24 and calf engagement portion 26 being a hinge 32 positioned approximately at the location of the knee of the individual, and the connection between calf engagement portion 26 and foot engagement portion 28 being a hinge joint 34 which generally replicates the ankle joint of the individual using the full body stretching device 10 of the present invention. Extension, retraction and rotation of the multi-axis joint 30, hinge 32, and hinge 34 will be performed by pneumatic, hydraulic, or other such actuating devices which control the extension, retraction, and range of motion of the various joints and hinges 30, 32, and 34 of the left leg support stretching section 22*b*. It is further preferred that the thigh, calf, and foot engagement portions 24, 26, and 28 each include shaped padding to accommodate the leg of the user of the present invention in a comfortable and safe orientation, as shown best in FIG. 1. Also, the thigh and calf engagement portions 24 and 26 would preferably include leg length extension shafts 36 and 38 operative to permit the thigh and calf engagement portions 24 and 26 to be lengthened or shortened to accommodate persons having longer or shorter legs, and to allow the user to personally fit the present invention to his or her particular leg length. The leg length extension shafts 36 and 38 may be either manually adjusted or may be mechanically adjusted by an appropriate powered extension device 39 such as a rotating screw or the like. Specifically, in the preferred embodiment, the powered extension device is shown in FIG. 5 as including a threaded powered screw 300 which is rotated by a stepping motor 302 to extend and retract the leg length extension shafts 36 and 38 for adjustment of the length of the right leg support stretching section 22*b*.

The leg support mounting shaft 21 and left and right leg support stretching sections 22*a* and 22*b* are preferably mounted on a rotating plate 36 on base 12 which rotates the leg support mounting shaft 21 and left and right leg support stretching sections 22*a* and 22*b* about a vertical axis generally aligned with the spine of the user of the present invention. This allows the torso of the user to be stretched by rotation of the pelvis relative to the upper body, although it should be noted that the upper section of the present invention could be modified to rotate instead of the lower section should such a modification be found to be desirable.

Mounted adjacent the upper end of central support shaft 14 is the arm support stretching section 40 which includes as its major elements left and right arm stretching portions 42*a* and 42*b* and a forward pivoting central chest and back engagement portion 44. As the left and right arm support stretching sections 42*a* and 42*b* are generally identical to one another, the following description of left arm support stretching section 42*a* should be understood to apply equally to right arm support stretching section 42*b*. Left arm support stretching section 42*a* would preferably include an upper arm engagement portion 48, a lower arm engagement portion 50, and a hand grip 52 mounted at the outer end of the left arm support stretching section 42*a*. As was described in connection with the right leg support stretching section 22*b*, the joints positioned between the various portions of the left arm support stretching section 42*a* are intended to generally replicate the joints found in the arm of the user of the full body stretching device 10 of the present invention, and would preferably include a multi-axis or hinge joint connection between the upper end of central support shaft 14 and upper arm engagement portion 48 of the left arm support stretching section 42*a*, the multi-axis or hinge joint 54 replicating the shoulder joint of the individual, the connection between the upper arm engagement portion 48 and lower arm engagement portion 50 being a hinge connection 56 which replicates the elbow of the user and the connection between the lower arm engagement portion 50 and hand grip portion 52 comprising a hinge joint 58 which replicates the wrist of the individual. Extension, retraction and rotation of the multi-axis/hinge joint 54, hinge 56, and hinge joint 58 will be performed by pneumatic, hydraulic, mechanical or other such actuating devices which control the extension, retraction, and range of motion of the various joints and hinges 30, 32, and 34 of the left arm support stretching section 42*a*. It is further preferred that the upper arm, lower arm, and hand engagement portions 48, 50, and 52 each include shaped padding to accommodate the arm and hand of the user of the present invention in a comfortable and safe orientation. Also, similar to what was described in connection with the leg support stretching sections 22*a* and 22*b*, the upper arm and lower arm engagement portions 48 and 50 would preferably include arm length extension shafts 60 and 62 operative to permit the upper arm and lower arm engagement portions 48 and 50 to be lengthened or shortened to accommodate persons having longer or shorter arms, and to allow the user to personally fit the present invention to his or her particular arm length. The arm length extension shafts 60 and 62 may be either manually adjusted or may be mechanically adjusted by an appropriate powered extension device 39 such as a rotating screw or the like. Specifically, in the preferred embodiment, the powered extension device is shown in FIG. 5 as including a threaded powered screw 300 which is rotated by a stepping motor 302 to extend and retract the arm length extension shafts 60 and 62 for adjustment of the length of the left arm support stretching section 42*a*.

Figure 6:
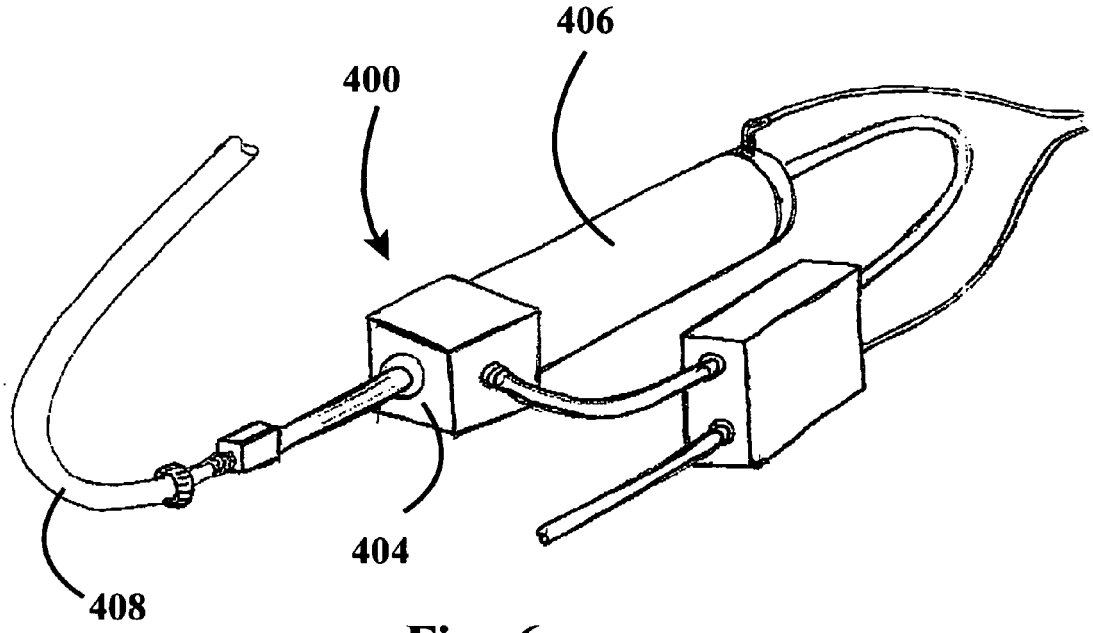
FIG. 6 is a perspective view of a pneumatic actuating device operative to power the flexing of the limbs of the present invention.
Figure 7:
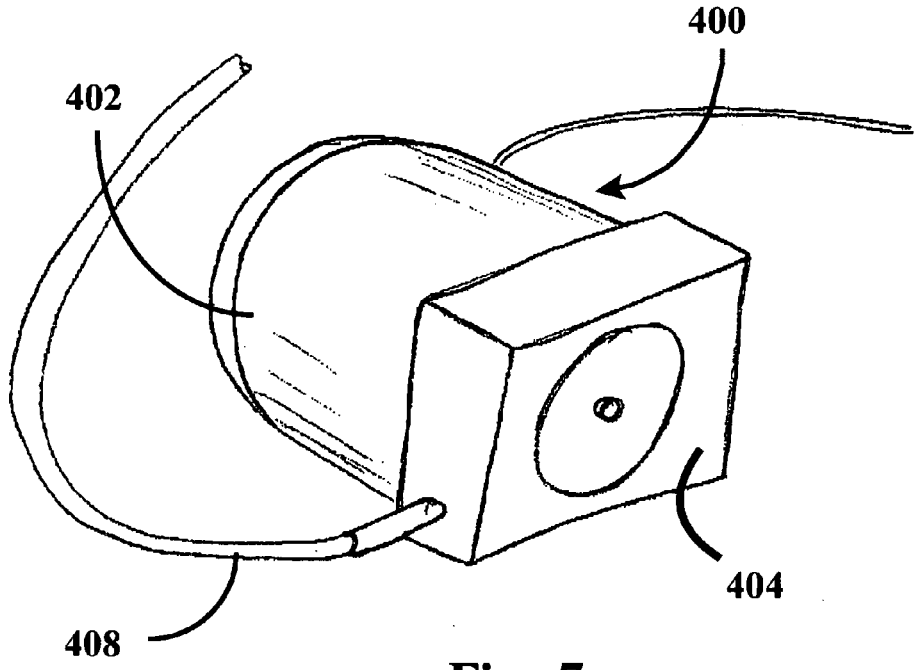
FIG. 7 is a perspective view of a programmable servo motor operative to power the flexing of the limbs of the present invention.
Figure 8:
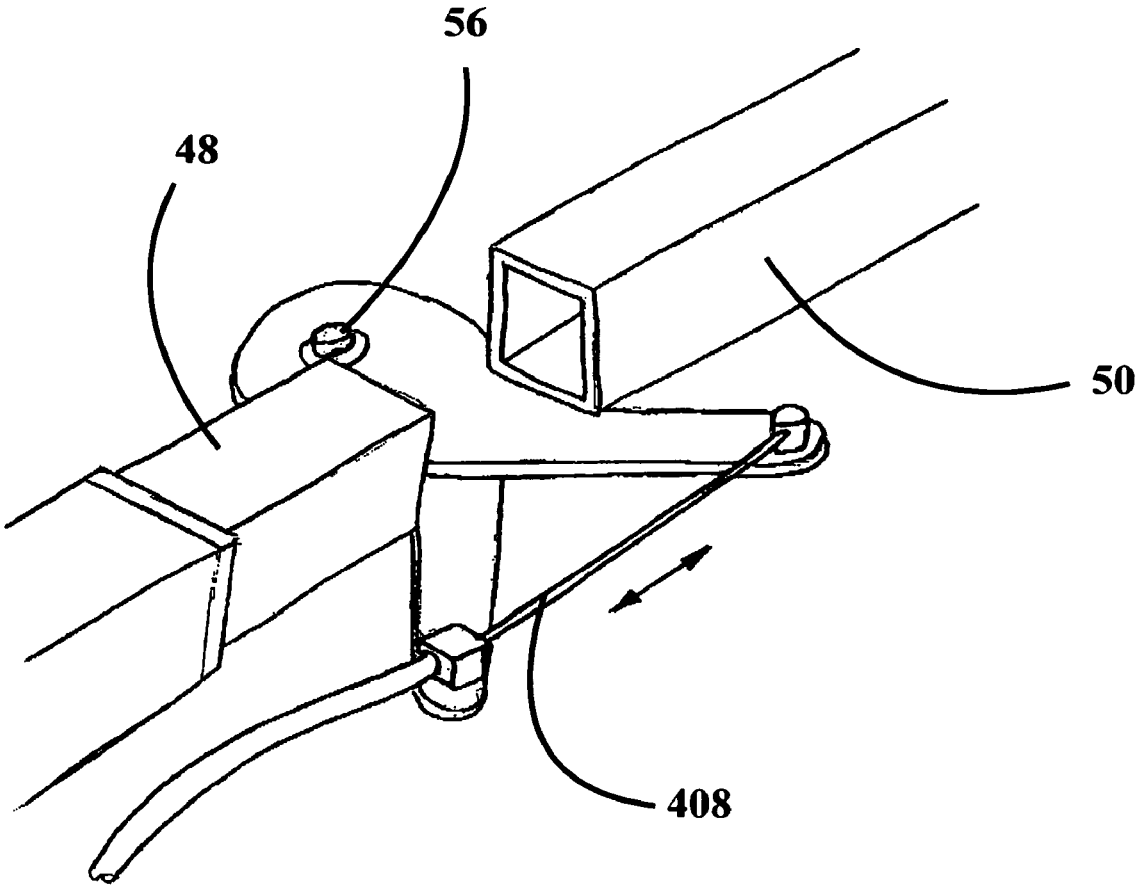
FIG. 8 is a detailed perspective view of a joint showing how the joint is actuated.
Figure 9:
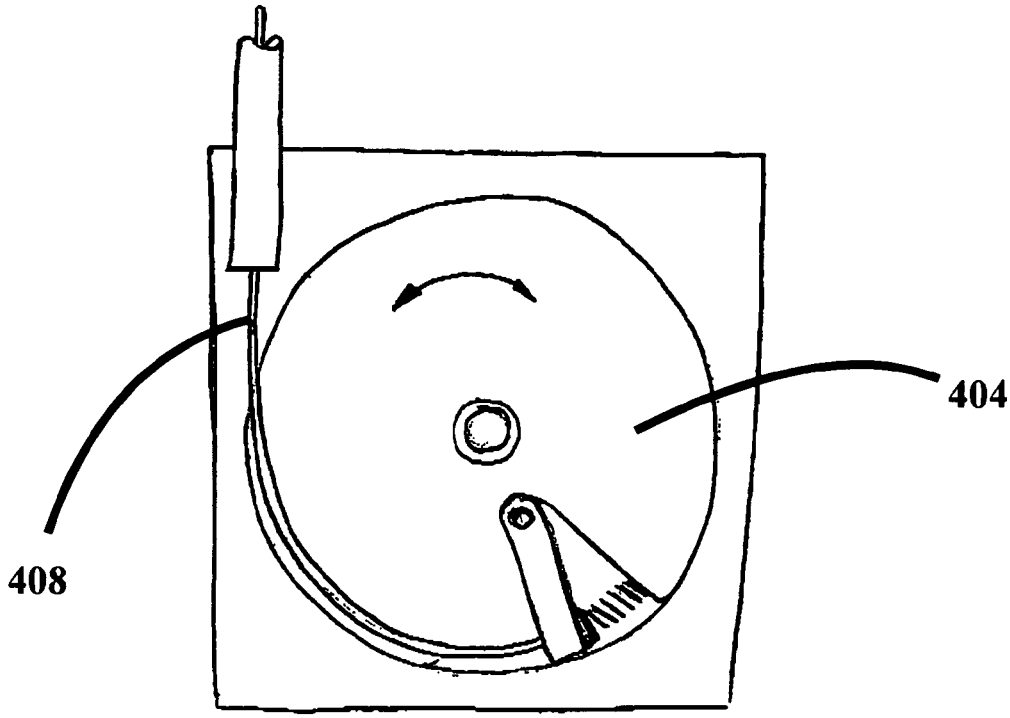
FIGS. 9 and 10 are, respectively, side elevational and perspective views of a bank of cable actuators and associated servo motors operative to power the flexing of the limbs of the present invention.
Figure 10:
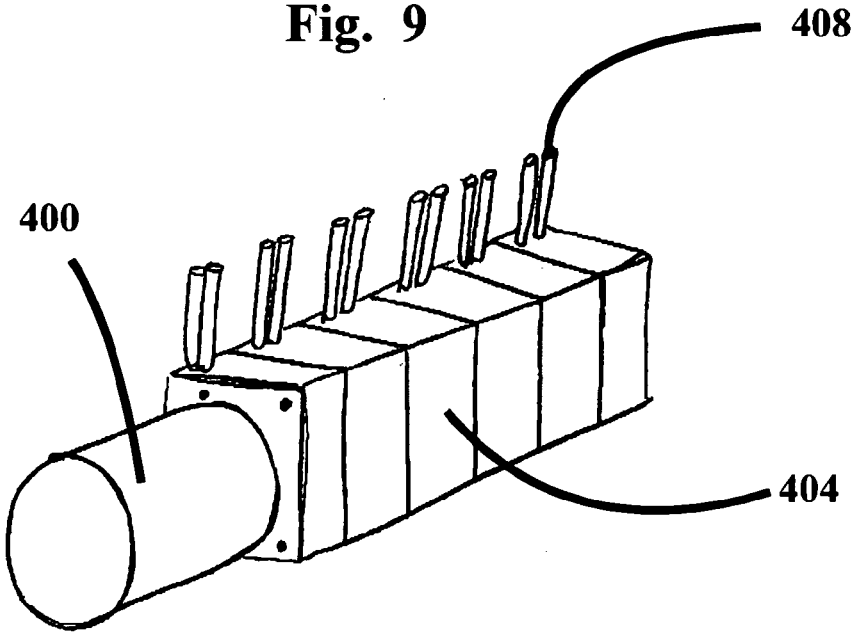

Moreover, each axis of movement in joints of the left and right leg support stretching sections 22*a* and 22*b* and the left and right arm support stretching sections 42*a* and 42*b* can be achieved with a push/pull mechanical cable mechanism 400 controlled either by a programmable servo motor 402 located under the base 12, as shown in FIG. 7, or by a pneumatic actuating device 406 located under the base 12 as shown in FIG. 6. The servo motors 400 will be gear reduced and connected to cable actuators 404, as shown in FIGS. 9 and 10. Each of these actuators will control a specific joint and only one pair of joints will be activated at any one time. When a particular joint is activated, the appropriate cable actuator 404 is activated and the variable torque of the servo motor 400 or the pistoning movement of the pneumatic actuating device 406 will apply an established amount of tension on the cable 408 which extends to the selected joint, shown in FIG. 8, thus causing the joint to move and apply pressure on the operator to complete the stretch. This mechanism is used in connection with each of the joints of the present invention.

The operation of the full body stretching device 10 of the present invention will be performed as follows. A user of the full body stretching device 10 would move to a position directly in front of the full body stretching device 10 with his or her back positioned against the back and shoulder support pad 20, then place their arms and legs in the respective left and right leg support stretching sections 22*a* and 22*b* and left and right arm support stretching sections 42*a* and 42*b*. The user of the present invention is retained within the full body stretching device 10 via the pads mounted on the left and right leg support stretching sections 22*a* and 22*b* and left and right arm support stretching sections 42*a* and 42*b*. Once the individual has inserted his or her limbs into the left and right leg support stretching sections 22*a* and 22*b* and left and right arm support stretching sections 42*a* and 42*b* prior to using the invention, the full body stretching device 10 is ready for operation to assist in the stretching of muscles and flexing of joints of the individual using the device.

Immediately prior to entering the full body stretching device 10, however, the user of the present invention would utilize the data input screen 70 of the computer system 72 which is operatively connected to the full body stretching device 10. This data input screen 70 is preferably a touch screen which will permit the user of the present invention to quickly and easily input the appropriate data on their individual characteristics to permit the machine to properly assist the individual in the stretching of the individual's body parts. In the preferred embodiment, the computer system 72 is programmed to operate the hydraulic and/or pneumatic connections of the full body stretching device 10 to extend or retract those connections, thus moving the various elements of the full body stretching device 10 to assist the user in the stretching of his or her body parts. The precise programming characteristics of the computer system 72 are not critical to the present invention, however, as it is the functionality of the computer system 72 which is important to properly drive the various elements of the full body stretching device 10 during the stretching process.

Once the user of the present invention has input his or her personal information into the touch screen 70 of computer system 72, the appropriate stretching program is instituted to drive the full body stretching device 10 to assist the individual with the stretching of his or her various body parts. For example, one such program may include upper body stretching procedures in which the left and right arm support stretching sections 42*a* and 42*b* will work in cooperation with the chest and upper back support section 44 to assist the user in performing various stretching movements which involve the extension, retraction and rotation of the arm support stretching sections 42*a* and 42*b* particularly by manipulation of the upper arm engagement portion relative to the lower arm engagement portion 50 via selected ones of the servo motors 400 and the manipulation of the handgrip portion 52 relative to the lower arm engagement portion 50 as was described previously. Similarly, a lower body stretching program would include manipulation of the individual's joints and muscles through extension, retraction and rotation of the left and right leg support stretching sections 22*a* and 22*b*, particularly focusing on the interconnectivity of the thigh, calf, and foot engagement portions 24, 26, and 28, and the intermanipulation of those elements. The precise stretching motions and exercises which will be used with the present invention may be modified or changed, depending on the user's abilities and desires, and therefore an in-depth discussion of those specific stretching motions and exercises will not be undertaken at this time. It should be noted, however, that the full body stretching device 10 of the present invention may be used for virtually any type of stretching exercise, and it is this adaptability which is a critical and useful feature of the present invention.

The computer system 72 is operatively connected to the servo motors 400 to command operation of the servo motors 400 to extend and retract the associated cable 404 thereby pivoting the selected joint. Further, the computer system 72 is operatively connected to the stepping motors 302 to command operation of the stepping motors 302 to rotate the threaded powered screw 300 to extend and retract the selected leg length extension shafts 36 and 38 and arm length extension shafts 60 and 62. The computer system 72 is shown in FIG. 1 as being mounted in the base 12, and would preferably be a standard PC based computer system including a processor, hard drive and other standard elements of a computer system. Regarding programming of the computer system 72, it is well-known how to program operation of motors via a computer system 72, and it is therefore believed that one skilled in art of programming operation of motors via a computer system 72 will be able to properly program the computer system 72 of the present invention.

It is to be understood that numerous modifications, additions, and substitutions may be made to the full body stretching device 10 of the present invention which fall within the intended broad scope of the above description. For example, additional joints may be included in the full body stretching device 10 such as those corresponding to the neck and spine of the individual to provide even more range of motion stretching programs which will further expand the possibilities of use of the present invention. Furthermore, the precise size, shape, and construction materials used in the present invention are not critical so long as the functional features of the full body stretching device 10 of the present invention are maintained. Also, it may be preferable to include a release button 90 positioned on each of the hand grips 52 which will operate to immediately return the full body stretching device 10 to its rest position in case the user is uncomfortable with the stretch being performed. The present invention may also include a back hinge 17 mounted on the central support shaft 14 which permits the upper section of the unit to bend forwards to flex the user's back for stretching thereof. Finally, although the present invention has been described as being driven by hydraulic, pneumatic or mechanical power, virtually any type of drive mechanism may be used with the present invention so long as the manipulation of joints and muscles by the invention is permitted.

There has therefore been shown and described a full body stretching device 10 which accomplishes at least all of its intended objectives.

I claim:

1. A full body stretching assist device comprising:

a base;

an upwardly extending central support shaft mounted on and extending upwards from said base;

left and right arm support stretching sections mounted on said central support shaft and extending outwards therefrom, each of said left and right arm support stretching sections including an upper arm engagement portion and a lower arm engagement portion;

left and right leg support stretching sections mounted on one of said base and said central support shaft, each of said left and right leg support stretching sections including a thigh engagement portion and a calf engagement portion;

said left and right arm support stretching sections each including a shoulder hinge joint connecting said center support shaft and said upper arm engagement portion and an elbow hinge joint connecting said upper arm engagement portion;

said left and right leg support stretching sections each including a hip joint connecting one of said central support shaft and said base and said thigh engagement portion and a knee hinge joint connecting said thigh engagement portion and said calf engagement portion;

powered movement means operatively connected to said left and right arm support stretching sections and said left and right leg support stretching sections for alternatively extending, retracting and pivoting said left and right arm support stretching sections and said left and right leg support stretching sections at said shoulder hinge joint and said elbow hinge joint, said hip multi-axis joint and said knee hinge such that said left and right arm support stretching sections and said left and right leg support stretching sections are movable in various directions to stretch and move arm and leg limbs being supported therein; and computing means operative to engage and control said powered movement means to alternatively extend, retract and pivot said left and right arm support stretching sections and said left and right leg support stretching sections at said shoulder hinge joint and said elbow hinge joint, said hip multi-axis joint and said knee hinge, thus providing controlled movement to said left and right arm support stretching sections and said left and right leg support stretching sections in various directions to stretch and move arm and leg limbs being supported therein.

2. The full body stretching assist device of claim 1 further comprising a leg support mounting shaft mounted on and extending upwards from said base, said left and right leg support stretching sections mounted on said leg support mounting shaft and depending downwards therefrom.

3. The full body stretching assist device of claim 2 further comprising a rotating plate mounted on said base, said leg support mounting shaft and said left and right leg support stretching sections mounted on said rotating plate operative to rotate said leg support mounting shaft and said left and right leg support stretching sections about a vertical axis generally aligned with the spine of the user for stretching of the torso of the user.

4. The full body stretching assist device of claim 1 wherein said powered movement means is selected from the group comprising pneumatic, hydraulic and mechanical actuating devices.

5. The full body stretching assist device of claim 1 further comprising an upper handle mounted on top of said central support shaft for grasping by the user of said full body stretching assist device for stretching of the upper body portion of the user.

6. The full body stretching assist device of claim 1 wherein said computing means comprises a computer system programmed to engage and control said powered movement means to alternatively extend, retract and pivot said left and right arm support stretching sections and said left and right leg support stretching sections at said shoulder hinge joint and said elbow hinge joint, said hip multi-axis joint and said knee hinge, thus moving the various elements of said full body stretching assist device to assist the user in the stretching of his/her body parts.

7. The full body stretching assist device of claim 1 further comprising arm length extension shafts mounted within said upper arm and lower arm engagement portions, said arm length extension shafts operative to permit said upper arm and lower arm engagement portions to be lengthened or shortened to accommodate persons having longer or shorter arms.

8. The full body stretching assist device of claim 1 further comprising leg length extension shafts mounted within said thigh and calf engagement portions, said leg length extension shafts operative to permit said thigh and calf engagement portions to be lengthened or shortened to accommodate persons having longer or shorter legs.

9. A full body stretching assist device comprising:

a base;

an upwardly extending central support shaft mounted on and extending upwards from said base;

a leg support mounting shaft mounted on and extending upwards from said base, said left and right leg support stretching sections mounted on said leg support mounting shaft and depending downwards therefrom;

a rotating plate mounted on said base, said leg support mounting shaft and said left and right leg support stretching sections mounted on said rotating plate operative to rotate said leg support mounting shaft and said left and right leg support stretching sections about a vertical axis generally aligned with the spine of the user for stretching of the torso of the user;

left and right arm support stretching sections mounted on said central support shaft and extending outwards therefrom, each of said left and right arm support stretching sections including an upper arm engagement portion, a lower arm engagement portion, and a hand grip mounted at the outer end of said lower arm engagement portion;

left and right leg support stretching sections mounted on one of said base and said central support shaft, each of said left and right leg support stretching sections including a thigh engagement portion, a calf engagement portion and a foot engagement portion mounted at the lower end of said calf engagement portion;

said left and right arm support stretching sections each including a shoulder hinge joint connecting said center support shaft and said upper arm engagement portion, an elbow hinge joint connecting said upper arm engagement portion and said lower arm engagement portion and a wrist hinge joint connecting said lower arm engagement portion and said hand grip portion;

said left and right leg support stretching sections each including a hip multi-axis joint connecting one of said central support shaft and said base and said thigh engagement portion, a knee hinge joint connecting said thigh engagement portion and said calf engagement portion and an ankle hinge joint connecting said calf engagement portion and said foot engagement portion;

powered movement means operatively connected to said left and right arm support stretching sections and said left and right leg support stretching sections for alternatively extending, retracting and pivoting said left and right arm support stretching sections and said left and right leg support stretching sections at said shoulder hinge joint, said elbow hinge joint, said wrist hinge joint, said hip multi-axis joint, said knee hinge and said ankle hinge joint such that said left and right arm support stretching sections and said left and right leg support stretching sections are movable in various directions to stretch and move arm and leg limbs being supported therein; and computing means operative to engage and control said powered movement means to alternatively extend, retract and pivot said left and right arm support stretching sections and said left and right leg support stretching sections at said shoulder hinge joint, said elbow hinge joint, said wrist hinge joint, said hip multi-axis joint, said knee hinge and said ankle hinge joint, thus providing controlled movement to said left and right arm support stretching sections and said left and right leg support stretching sections in various directions to stretch and move arm and leg limbs being supported therein.

10. The full body stretching assist device of claim 9 wherein said powered movement means is selected from the group comprising pneumatic, hydraulic and mechanical actuating devices.

11. The full body stretching assist device of claim 9 further comprising an upper handle mounted on top of said central support shaft for grasping by the user of said full body stretching assist device for stretching of the upper body portion of the user.

12. The full body stretching assist device of claim 9 wherein said computing means comprises a computer system programmed to engage and control said powered movement means to alternatively extend, retract and pivot said left and right arm support stretching sections and said left and right leg support stretching sections at said shoulder hinge joint, said elbow hinge joint, said wrist hinge joint, said hip multi-axis joint, said knee hinge and said ankle hinge joint, thus moving the various elements of said full body stretching assist device to assist the user in the stretching of his/her body parts.

13. The full body stretching assist device of claim 9 further comprising arm length extension shafts mounted within said upper arm and lower arm engagement portions, said arm length extension shafts operative to permit said upper arm and lower arm engagement portions to be lengthened or shortened to accommodate persons having longer or shorter arms.

14. The full body stretching assist device of claim 9 further comprising leg length extension shafts mounted within said thigh and calf engagement portions, said leg length extension shafts operative to permit said thigh and calf engagement portions to be lengthened or shortened to accommodate persons having longer or shorter legs.

15. A full body stretching assist device comprising:

a base;

an upwardly extending central support shaft mounted on and extending upwards from said base;

left and right arm support stretching sections mounted on said central support shaft and extending outwards therefrom, each of said left and right arm support stretching sections including an upper arm engagement portion, a lower arm engagement portion, and a hand grip mounted at the outer end of said lower arm engagement portion;

left and right leg support stretching sections mounted on one of said base and said central support shaft, each of said left and right leg support stretching sections including a thigh engagement portion, a calf engagement portion and a foot engagement portion mounted at the lower end of said calf engagement portion;

said left and right arm support stretching sections each including a shoulder hinge joint connecting said center support shaft and said upper arm engagement portion, an elbow hinge joint connecting said upper arm engagement portion and said lower arm engagement portion and a wrist hinge joint connecting said lower arm engagement portion and said hand grip portion;

said left and right leg support stretching sections each including a hip multi-axis joint connecting one of said central support shaft and said base and said thigh engagement portion, a knee hinge joint connecting said thigh engagement portion and said calf engagement portion and an ankle hinge joint connecting said calf engagement portion and said foot engagement portion;

powered movement means operatively connected to said left and right arm support stretching sections and said left and right leg support stretching sections for alternatively extending, retracting and pivoting said left and right arm support stretching sections and said left and right leg support stretching sections at said shoulder hinge joint, said elbow hinge joint, said wrist hinge joint, said hip multi-axis joint, said knee hinge and said ankle hinge joint such that said left and right arm support stretching sections and said left and right leg support stretching sections are movable in various directions to stretch and move arm and leg limbs being supported therein; and computing means operative to engage and control said powered movement means to alternatively extend, retract and pivot said left and right arm support stretching sections and said left and right leg support stretching sections at said shoulder hinge joint, said elbow hinge joint, said wrist hinge joint, said hip multi-axis joint, said knee hinge and said ankle hinge joint, thus providing controlled movement to said left and right arm support stretching sections and said left and right leg support stretching sections in various directions to stretch and move arm and leg limbs being supported therein.

* * * * *